US009152156B2

(12) United States Patent
Ueda

(10) Patent No.: US 9,152,156 B2
(45) Date of Patent: Oct. 6, 2015

(54) STEP-DOWN REGULATOR

(71) Applicant: KABUSHIKI KAISHA TOSHIBA, Minato-ku, Tokyo (JP)

(72) Inventor: Norihiro Ueda, Kawasaki (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 199 days.

(21) Appl. No.: 13/901,435

(22) Filed: May 23, 2013

(65) Prior Publication Data

US 2014/0232363 A1 Aug. 21, 2014

(30) Foreign Application Priority Data

Feb. 19, 2013 (JP) ..... 2013-030171

(51) Int. Cl.
*G05F 1/00* (2006.01)
*G05F 1/565* (2006.01)
*G05F 1/46* (2006.01)

(52) U.S. Cl.
CPC ..... *G05F 1/465* (2013.01)

(58) Field of Classification Search
CPC ..... G05F 1/00; G05F 1/465; G05F 1/565; G05F 1/575
USPC ..... 323/223–226, 268, 271, 273, 275, 280, 323/281, 282, 285
See application file for complete search history.

(56) References Cited

U.S. PATENT DOCUMENTS 5,041,777 A * 8/1991 Riedger ..... 323/277
5,670,865 A * 9/1997 Farwell ..... 323/285
5,801,584 A 9/1998 Mori
6,066,943 A * 5/2000 Hastings et al. ..... 323/285
6,433,521 B1 * 8/2002 Chen et al. ..... 323/224
6,541,946 B1 * 4/2003 Chen et al. ..... 323/280
6,906,902 B2 6/2005 Watanabe
7,319,314 B1 * 1/2008 Maheshwari et al. ..... 323/313

(Continued)

FOREIGN PATENT DOCUMENTS

JP 11-134044 A 5/1999
JP 11338559 A 12/1999

(Continued)

OTHER PUBLICATIONS

Japanese Office Action (and English translation thereof) dated May 22, 2015, issued in counterpart Japanese Application No. 2013-030171.

*Primary Examiner* — Matthew Nguyen

(74) *Attorney, Agent, or Firm* — Holtz, Holtz, Goodman & Chick PC

(57) ABSTRACT

The step-down regulator includes a first error amplifying circuit that receives a first reference voltage and the first voltage and supplies a first control signal to a control terminal of the first transistor so that the first reference voltage and the first voltage are equal to each other. The step-down regulator includes a second error amplifying circuit that receives a voltage at the second end of the current controlling circuit and a second reference voltage and supplies a second control signal to the current controlling circuit so that the voltage at the second end of the current controlling circuit and the second reference voltage are equal to each other. The step-down regulator includes a diode that is connected to the second end of the current controlling circuit at an anode thereof and to the second potential at a cathode thereof.

20 Claims, 7 Drawing Sheets

(56) References Cited

U.S. PATENT DOCUMENTS

2014/0117952 A1* 5/2014 Li ..... 323/271
2014/0354249 A1* 12/2014 Kurozo et al. ..... 323/271

FOREIGN PATENT DOCUMENTS

JP 2004206633 A 7/2004
JP 2006277360 A 10/2006

* cited by examiner

STEP-DOWN REGULATOR

CROSS-REFERENCE TO RELATED APPLICATION

This application is based upon and claims the benefit of priority from the prior Japanese Patent Application No. 2013-030171, filed on Feb. 19, 2013, the entire contents of which are incorporated herein by reference.

BACKGROUND

1. Field

Embodiments described herein relate generally to a step-down regulator.

2. Background Art

As conventionally known, there is a source-follower type step-down regulator.

DETAILED DESCRIPTION

A step-down regulator according to an embodiment includes a first transistor connected to a first potential at a first end thereof. The step-down regulator includes a voltage generating circuit that is connected between a second end of the first transistor and a second potential lower than the first potential and outputs a first voltage that is based on a voltage at the second end of the first transistor. The step-down regulator includes a first error amplifying circuit that receives a first reference voltage and the first voltage and supplies a first control signal to a control terminal of the first transistor so that the first reference voltage and the first voltage are equal to each other. The step-down regulator includes an output terminal at which an output voltage is output. The step-down regulator includes a second transistor that is connected to the first potential at a first end thereof, to the output terminal at a second end and to the control terminal of the first transistor at a control terminal thereof and receives the first control signal at the control terminal thereof. The step-down regulator includes a current controlling circuit that is connected to the output terminal at a first end thereof and is capable of controlling a current that flows between the first end thereof connected to the output terminal and a second end thereof. The step-down regulator includes a second error amplifying circuit that receives a voltage at the second end of the current controlling circuit and a second reference voltage and supplies a second control signal to the current controlling circuit so that the voltage at the second end of the current controlling circuit and the second reference voltage are equal to each other. The step-down regulator includes a diode that is connected to the second end of the current controlling circuit at an anode thereof and to the second potential at a cathode thereof. The step-down regulator includes a linear load that is connected in parallel with the diode between the second end of the current controlling circuit and the second potential.

In the following, embodiments will be described with reference to the drawings.

(First Embodiment)

Figure 1:
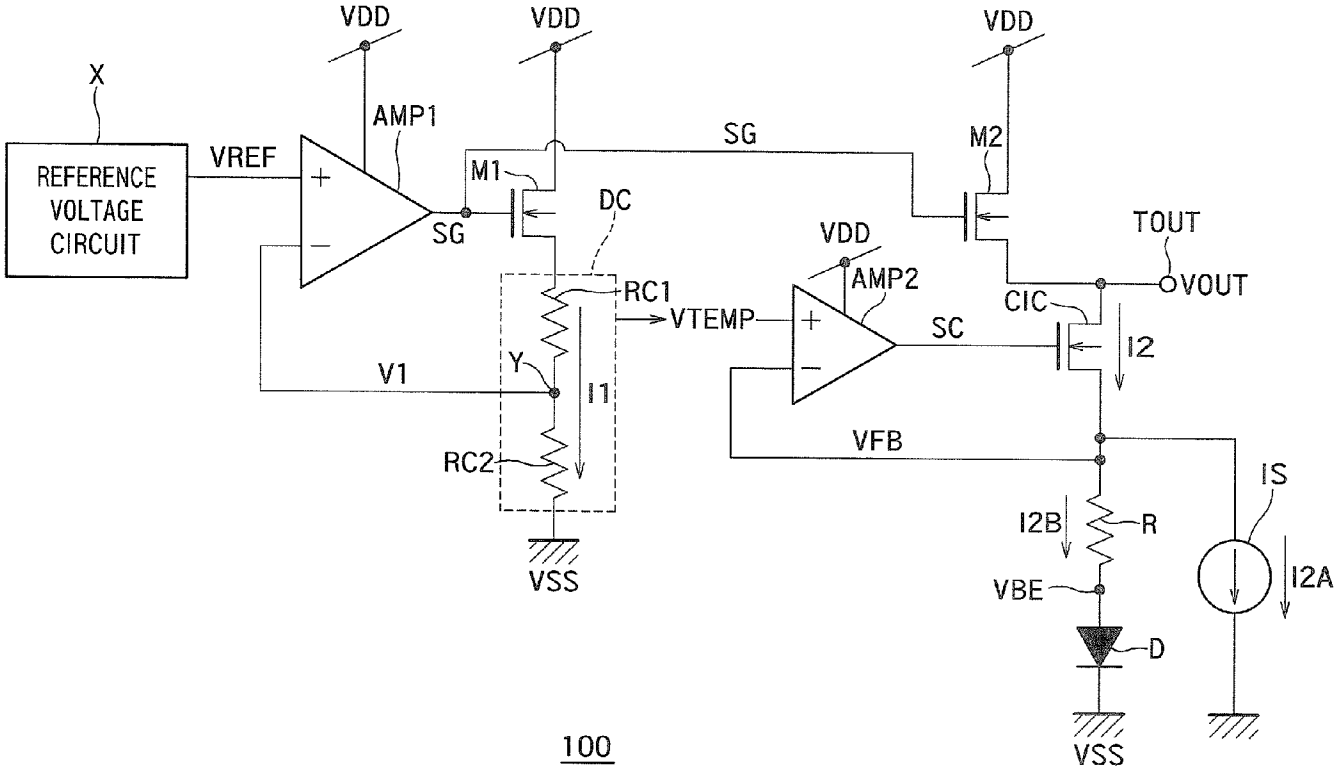
FIG. 1 is a circuit diagram showing an example of a configuration of a step-down regulator 100 according to a first embodiment.

FIG. 1 is a circuit diagram showing an example of a configuration of a step-down regulator 100 according to a first embodiment.

As shown in FIG. 1, the step-down regulator 100 includes a first nMOS transistor (a first transistor) "M1", a second nMOS transistor (a second transistor) "M2", a voltage generating circuit (a voltage dividing circuit) "DC", a first error amplifying circuit "AMP1", an output terminal "TOUT", a current controlling circuit "CIC", a second error amplifying circuit "AMP2", a p-n junction diode (a diode) "D", a linear load "IS", and a limiting resistor "R".

A power supply (at a first potential) "VDD" is an LSI power supply. The first potential, which is a power supply potential in this example, is a high potential higher than a ground potential.

A reference voltage circuit "X" is configured to generate and output a fixed first reference voltage "VREF", which is less affected by the power supply voltage of the power supply "VDD" and the temperature.

The first nMOS transistor "M1" is connected to the power supply "VDD" at a drain (one end) thereof.

The voltage generating circuit "DC" is connected between a source (another end) of the first nMOS transistor "M1" and a ground (at a second potential) "VSS" and is configured to output a first voltage (a first divided voltage) "V1" obtained by dividing the voltage between the source of the first nMOS transistor "M1" and the ground "VSS". The second potential is a potential lower than the first potential and is the ground potential in this example.

The voltage generating circuit "DC" has a first voltage dividing resistor "RC1" and a second voltage dividing resistor "RC2" as shown in FIG. 1, for example.

The first voltage dividing resistor "RC1" is connected to the source of the first nMOS transistor "M1" at one end thereof.

The second voltage dividing resistor "RC2" is connected to the other end of the first voltage dividing resistor "RC1" at one end thereof and to the ground "VSS" at the other end thereof.

In the case of the circuit configuration shown in FIG. 1, the voltage generating circuit "DC" is configured to output the voltage between the other end of the first voltage dividing resistor and the one end of the second voltage dividing resistor (that is, the voltage at a node "Y") as the first voltage "V1".

That is, the voltage generating circuit "DC" is configured to output the first voltage "V1" responsive to the voltage between the source of the first nMOS transistor "M1" and the ground "VSS".

The first error amplifying circuit "AMP1" receives the fixed first reference voltage "VREF" at a non-inverting input terminal thereof and receives the first voltage "V1" at an inverting input terminal thereof.

The first error amplifying circuit "AMP1" is configured to supply a first control signal "SG" to a gate of the first nMOS transistor "M1", thereby making the first nMOS transistor "M1" operate in a weak inversion region so that the first reference voltage "VREF" and the first voltage "V1" are equal to each other.

The output terminal "TOUT" is configured to output an output voltage "VOUT".

The second nMOS transistor "M2" is connected to the power supply "VDD" at a drain (one end) thereof, to the output terminal "TOUT" at a source (another end) thereof and to the gate (a control terminal) of the first nMOS transistor "M1" at a gate (a control terminal) thereof. The second nMOS transistor "M2" is configured to receive the first control signal "SG" at the gate thereof and operate in the weak inversion region as with the first nMOS transistor "M1".

The current controlling circuit "CIC" is connected to the output terminal "TOUT" at one end thereof. The current controlling circuit "CIC" is capable of controlling a current "I2" that flows between the one end thereof connected to the output terminal "TOUT" and another end thereof.

As shown in FIG. 1, the current controlling circuit "CIC" is a MOS transistor that receives a second control signal "SC" at a gate thereof and operates under the control of the second control signal "SC". That is, the MOS transistor operates under the control of the second control signal "SC" and controls the current "I2" that flows between the one end (a source) thereof connected to the output terminal "TOUT" and another end (a drain) thereof.

More specifically, as shown in FIG. 1, the current controlling circuit "CIC" is an nMOS transistor that is connected to the output terminal "TOUT" at the drain thereof, to an inverting input terminal of the second error amplifying circuit "AMP2" at the source thereof and to an output of the second error amplifying circuit "AMP2" at a gate thereof and receives the second control signal "SC" at the gate.

The second error amplifying circuit "AMP2" is configured to receive a detected voltage "VFB" at the other end of the current controlling circuit "CIC" and a second reference voltage "VTEMP" that is based on the voltage at the source of the first nMOS transistor "M1". In particular, as shown in FIG. 1, the second error amplifying circuit "AMP2" is configured to receive the second reference voltage "VTEMP" at a non-inverting input terminal thereof and the detected voltage "VFB" at the inverting input terminal thereof.

The error amplifying circuit "AMP2" is further configured to supply the second control signal "SC" to the current controlling circuit "CIC", thereby controlling the current "I2" that flows between the one end and the other end of the current controlling circuit "CIC" so that the detected voltage "VFB" and the second reference voltage "VTEMP" are equal to each other.

As can be seen from the above description, the other end of the current controlling circuit "CIC" (the source of the nMOS transistor) and the node at which the second reference voltage "VTEMP" is supplied are virtually short-circuited, and therefore, the second error amplifying circuit "AMP2" controls the current controlling circuit "CIC" to flow the current "I2" from the output terminal "TOUT" so that the detected voltage "VFB" is maintained at the second reference voltage "VTEMP".

The second reference voltage "VTEMP" described above is a second voltage obtained by the voltage generating circuit "DC" dividing the voltage between the source of the first nMOS transistor "M1" and the ground "VSS". The divided voltage can be equal to the first voltage "V1".

Thus, the second reference voltage "VTEMP" is a fixed voltage less affected by the power supply voltage and the temperature.

The second reference voltage "VTEMP", which is a fixed voltage less affected by the temperature as described above, can be generated by an arrangement other than the voltage dividing circuit.

The p-n junction diode "D" is connected to the other end of the current controlling circuit "CIC" at an anode thereof and to the ground "VSS" at a cathode thereof.

The linear load "IS" is connected in parallel with the p-n junction diode "D" between the other end of the current controlling circuit "CIC" and the ground "VSS".

As shown in FIG. 1, the linear load "IS" is a constant current source that outputs a constant current. The linear load "IS" may be a resistor.

The limiting resistor "R" is connected between the other end of the current controlling circuit "CIC" and the anode of the p-n junction diode "D". As described later, the limiting resistor "R" may be an MOS transistor that receives a constant voltage at a gate thereof, for example.

Next, characteristics of an operation of the step-down regulator 100 configured as described above will be described.

Figure 2:
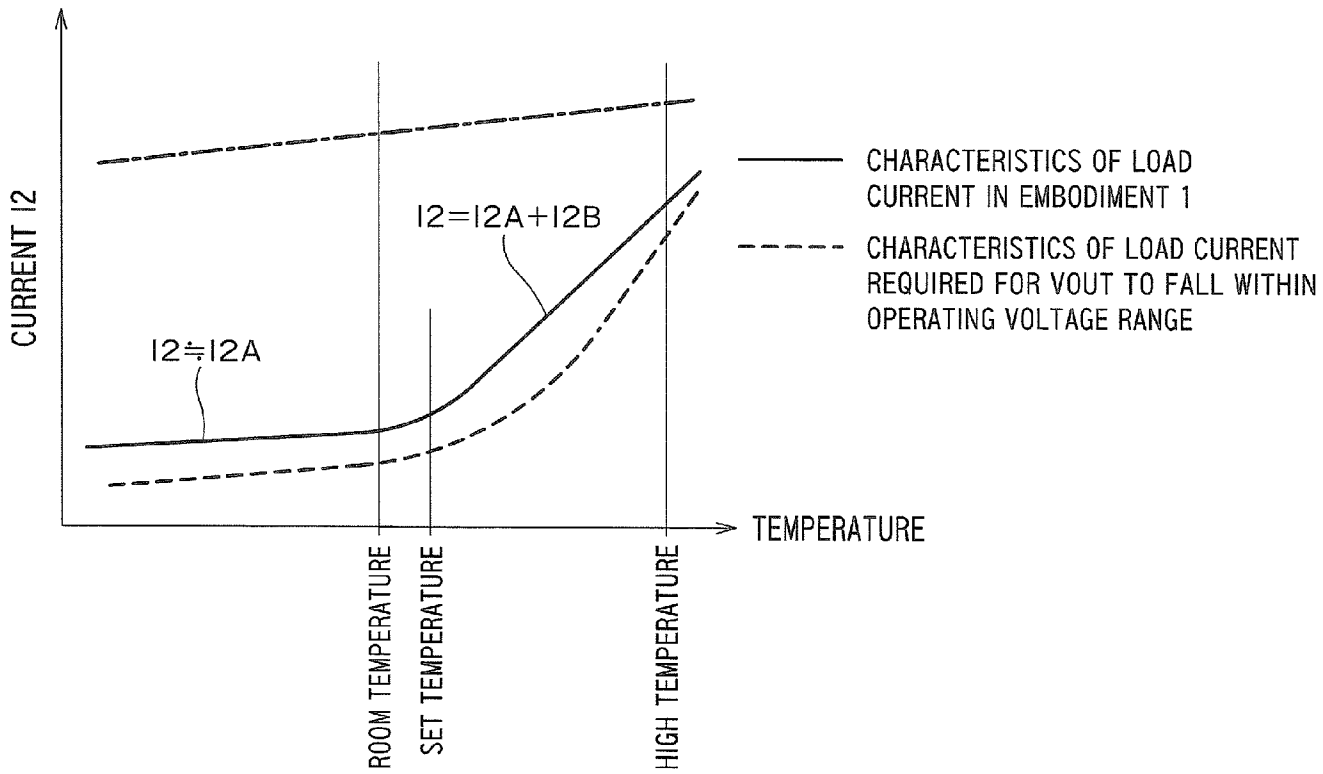
FIG. 2 is a graph showing temperature characteristics of the load current flowing through the current controlling circuit "CIC" of the step-down regulator 100 shown in FIG. 1.
Figure 3:
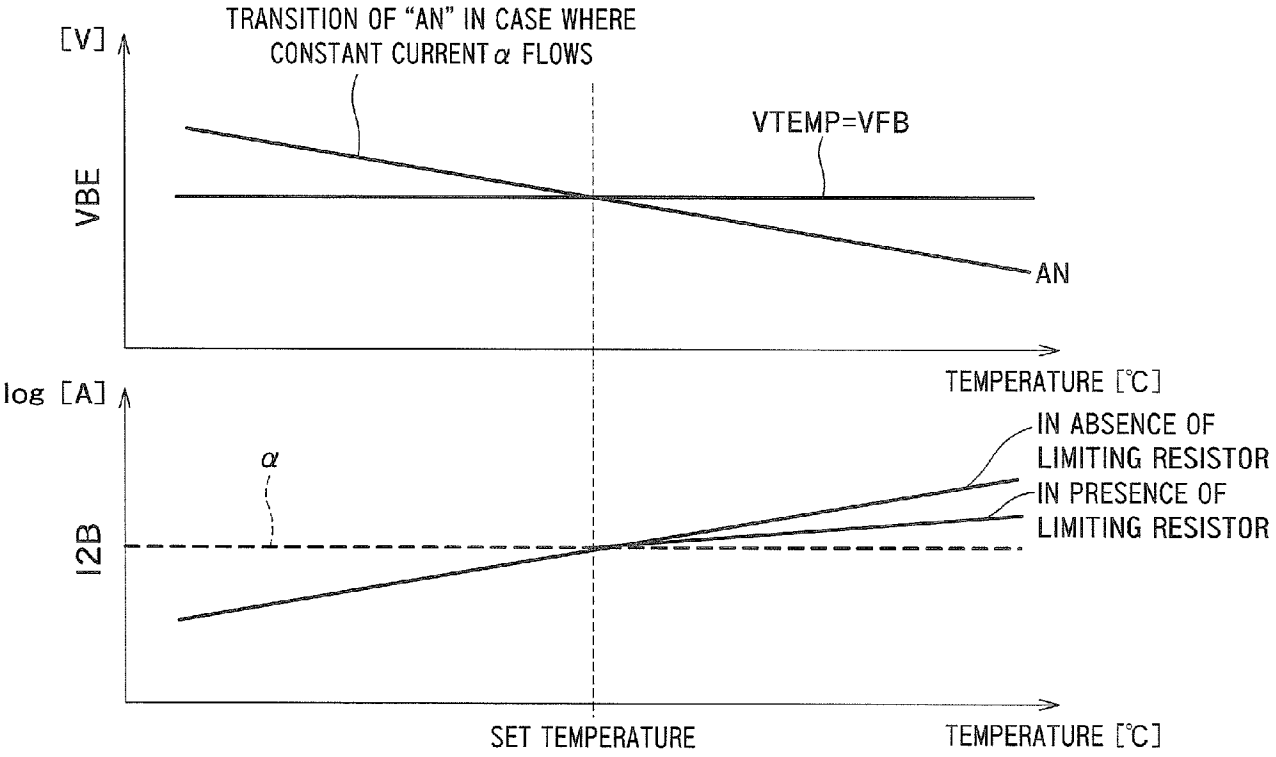
FIG. 3 is a diagram showing a relationship between an anode voltage "VBE" and temperature and a relationship between a current "I2B" and temperature of the step-down regulator 100 shown in FIG. 1.

FIG. 2 is a graph showing temperature characteristics of the load current flowing through the current controlling circuit "CIC" of the step-down regulator 100 shown in FIG. 1. In the drawing, the dashed line schematically shows temperature characteristics of the load current flowing from the output terminal "TOUT" to the ground "VSS" required for the output voltage "VOUT" of the step-down regulator 100 to fall within an operating voltage range. The alternate long and short dashed line schematically shows temperature characteristics of the load current flowing from the output terminal "TOUT" to the ground "VSS" in the case where only the linear load exists between the output terminal "TOUT" and the ground "VSS". FIG. 3 is a diagram showing a relationship between an anode voltage "VBE" and temperature and a relationship between a current "I2B" and temperature of the step-down regulator 100 shown in FIG. 1.

Since the second reference voltage "VTEMP" and the detected voltage "VFB" are virtually short-circuited, the second reference voltage "VTEMP" is equal to the detected voltage "VFB" (VTEMP=VFB).

In FIG. 3, the downward-sloping straight line shows an anode voltage "AN" in the case where a constant current $\alpha$ is applied to the diode "D".

The constant current $\alpha$ is the value of the current "I2B" at a set temperature.

The anode voltage "AN" of the p-n junction diode "D" has negative temperature characteristics.

The current "I2B" flowing to the diode "D" has an exponential amplification factor with respect to the anode voltage "VBE".

The current "I2B" on the vertical axis of FIG. 3 is shown in a logarithmic scale.

As shown in FIG. 3, for example, in the case where the second reference voltage "VTEMP" is lower than the anode voltage "AN" at a certain temperature (the set temperature) (VTEMP<AN), the current "I2B" flowing to the diode "D" is sufficiently lower than the current $\alpha$ (I2B<<$\alpha$), because the anode voltage "AN" required to flow the current $\alpha$ cannot be achieved. That is, the current "I2" assumes approximately the same value as a current "I2A".

In the case where the second reference voltage "VTEMP" is higher than the anode voltage "AN" at a certain temperature (the set temperature) (VTEMP>AN), a current larger than the current α can flow, because an anode voltage "VBE" higher than the anode voltage "AN" required to flow the current α can be achieved. That is, the second error amplifying circuit "AMP2" controls the current controlling circuit "CIC" to provide a current from the output terminal "TOUT" so as to make the anode voltage "VBE" equal to the second reference voltage "VTEMP".

At this time, the current "I2B" exponentially increases with respect to the temperature. Thus, the limiting resistor "R" limits the current so as to prevent the current "I2B" from becoming too large (FIG. 3). That is, the current "I2" is the sum of the current "I2A" and the current "I2B".

In the case where the second reference voltage "VTEMP" is equal to the anode voltage (VTEMP=AN), the current "I2B" is equal to α (I2B=α). That is, the current "I2" is the sum of the current "I2A" and α (I2A+α) (FIGS. 2 and 3).

This means that, provided that the set current α is constant, the detected (set) temperature becomes higher as the second reference voltage "VTEMP" is set lower and becomes lower as the second reference voltage "VTEMP" is set higher.

Therefore, the temperature to increase the current can be set by setting the second reference voltage "VTEMP".

As can be seen from the above description, the step-down regulator 100 can control the point of change of the load current applied to the output terminal "TOUT" based on the temperature by adjusting the second reference voltage "VTEMP".

As shown by the dashed line in FIG. 2, the load current "I2" required for the step-down regulator 100 increases at high temperatures. Therefore, in the case where only the linear load exists between the output terminal "TOUT" and the ground "VSS", the load current "I2" is excessive at room temperature and is wasted. To the contrary, as in this embodiment, if not only the linear load but also the p-n junction diode connected in parallel with the linear load between the output terminal "TOUT" and the ground "VSS" and the current controlling circuit "CIC" connected between the output terminal "TOUT" and the linear load and p-n junction diode are provided to perform a control based on temperature adjustment, the excess of the current at room temperature can be reduced.

Furthermore, as described above, the current controlling circuit "CIC" is configured as an nMOS transistor in a source follower connection. As a result, the voltage between the gate and the source of the nMOS transistor is stable and less affected by a variation of the output voltage "VOUT".

As described above, the step-down regulator according to the first embodiment can reduce power consumption.

(Second Embodiment)

In a second embodiment, an example of a configuration of a step-down regulator including a current controlling circuit formed by a pMOS transistor will be described.

Figure 4:
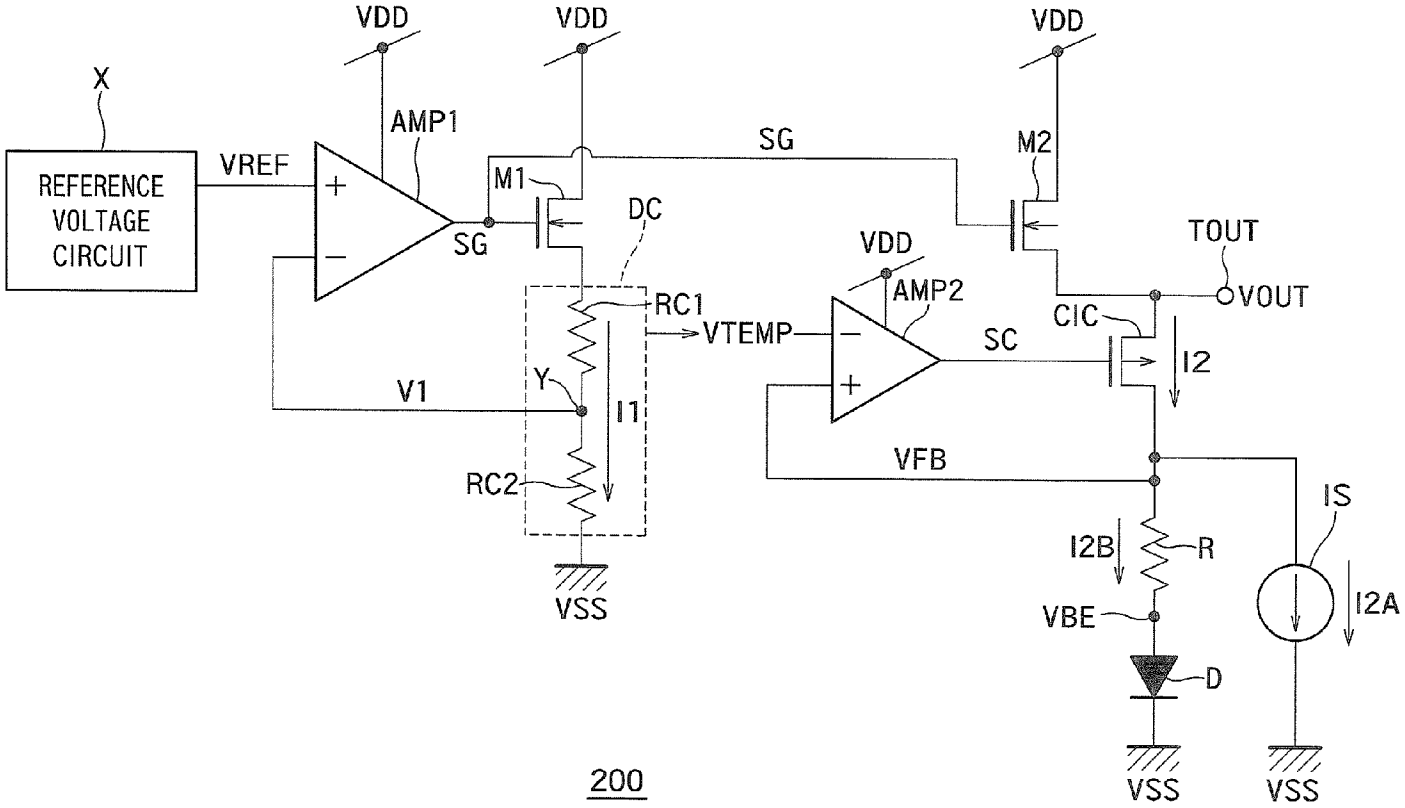
FIG. 4 is a circuit diagram showing an example of a configuration of a step-down regulator 200 according to the second embodiment.

FIG. 4 is a circuit diagram showing an example of a configuration of a step-down regulator 200 according to the second embodiment. In FIG. 4, the same reference numerals as those in FIG. 1 denote the same components as those in the first embodiment.

As shown in FIG. 4, as with the step-down regulator 100 according to the first embodiment, the step-down regulator 200 includes a first nMOS transistor "M1", a second nMOS transistor "M2", a voltage generating circuit "DC", a first error amplifying circuit "AMP1", an output terminal "TOUT", a current controlling circuit "CIC", a second error amplifying circuit "AMP2", a p-n junction diode "D", a linear load "IS", and a limiting resistor "R".

As shown in FIG. 4, according to the second embodiment, the second error amplifying circuit "AMP2" receives a second reference voltage "VTEMP" at an inverting input terminal thereof and receives a detected voltage "VFB" at a non-inverting input terminal thereof.

Moreover, The current controlling circuit "CIC" is a pMOS transistor that is connected to an output terminal "TOUT" at a source thereof, to the inverting input terminal of the second error amplifying circuit "AMP2" at a drain thereof and to an output of the second error amplifying circuit "AMP2" at a gate thereof and receives a second control signal "SC" at the gate thereof.

The remainder of the configuration of the step-down regulator. 200 is the same as that of the step-down regulator 100 shown in FIG. 1.

The operating characteristics of the step-down regulator 200 configured as described above are the same as the operating characteristics described in the first embodiment.

That is, as with the step-down regulator 100 according to the first embodiment, the step-down regulator 200 according to the second embodiment can reduce power consumption.

(Third Embodiment)

In a third embodiment, an example of a configuration of a step-down regulator including a p-n junction diode formed by a bipolar transistor will be described.

Figure 5:
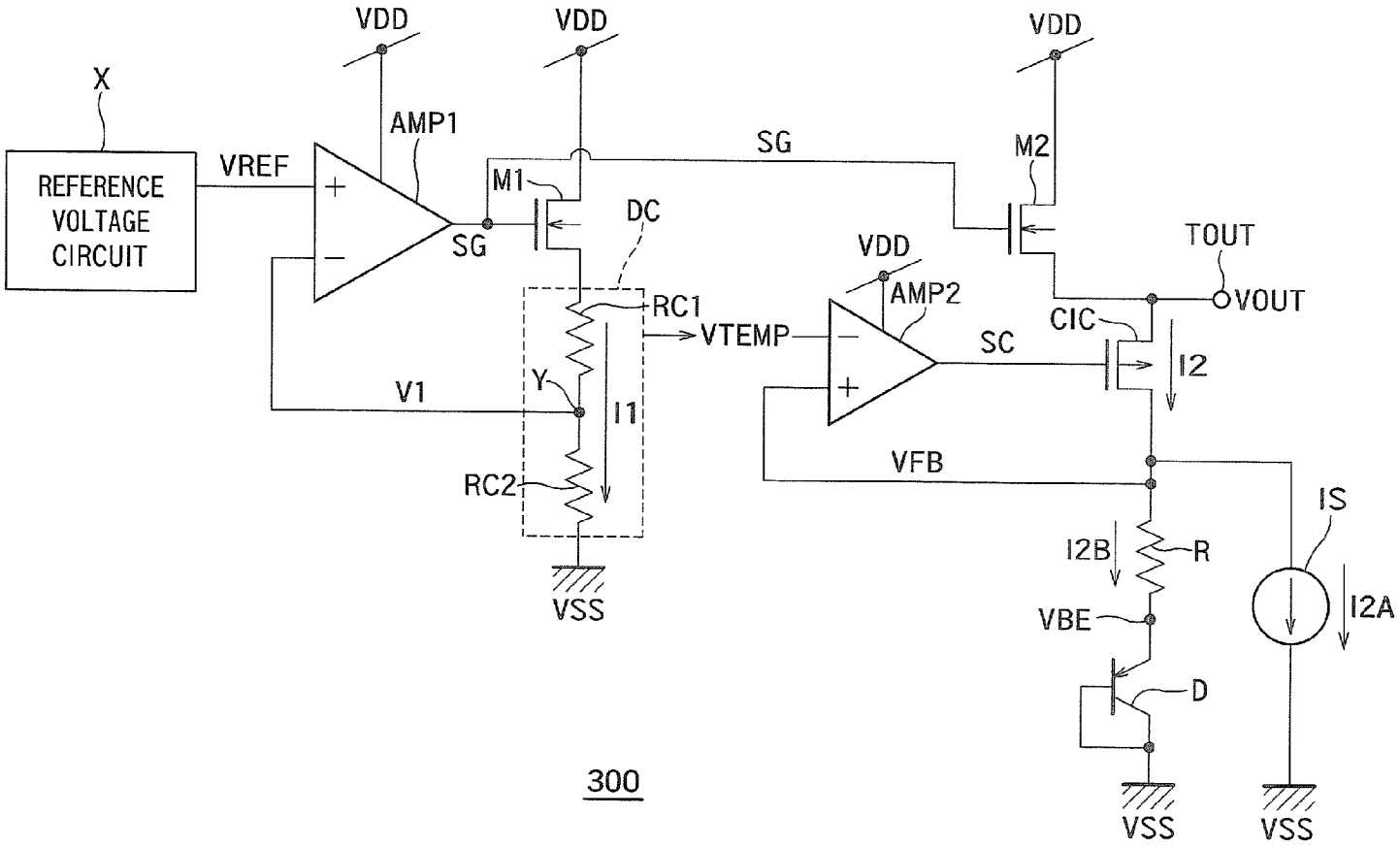
FIG. 5 is a circuit diagram showing an example of a configuration of a step-down regulator 300 according to the third embodiment.

FIG. 5 is a circuit diagram showing an example of a configuration of a step-down regulator 300 according to the third embodiment. In FIG. 5, the same reference numerals as those in FIG. 1 denote the same components as those in the first embodiment.

As shown in FIG. 5, as with the step-down regulator 100 according to the first embodiment, the step-down regulator 300 includes a first nMOS transistor "M1", a second nMOS transistor "M2", a voltage generating circuit "DC", a first error amplifying circuit "AMP1", an output terminal "TOUT", a current controlling circuit "CIC", a second error amplifying circuit "AMP2", a p-n junction diode "D", a linear load "IS", and a limiting resistor "R".

According to the third embodiment, the p-n junction diode "D" is a PNP bipolar transistor connected to the limiting resistor "R" at an emitter thereof and to a ground "VSS" at a collector and a base thereof.

The remainder of the configuration of the step-down regulator 300 is the same as that of the step-down regulator 100 shown in FIG. 1.

The operating characteristics of the step-down regulator 300 configured as described above are the same as the operating characteristics described in the first embodiment.

That is, as with the step-down regulator 100 according to the first embodiment, the step-down regulator 300 according to the third embodiment can reduce power consumption.

(Fourth Embodiment)

In a fourth embodiment, an example of a configuration of another step-down regulator including a p-n junction diode formed by a bipolar transistor will be described.

Figure 6:
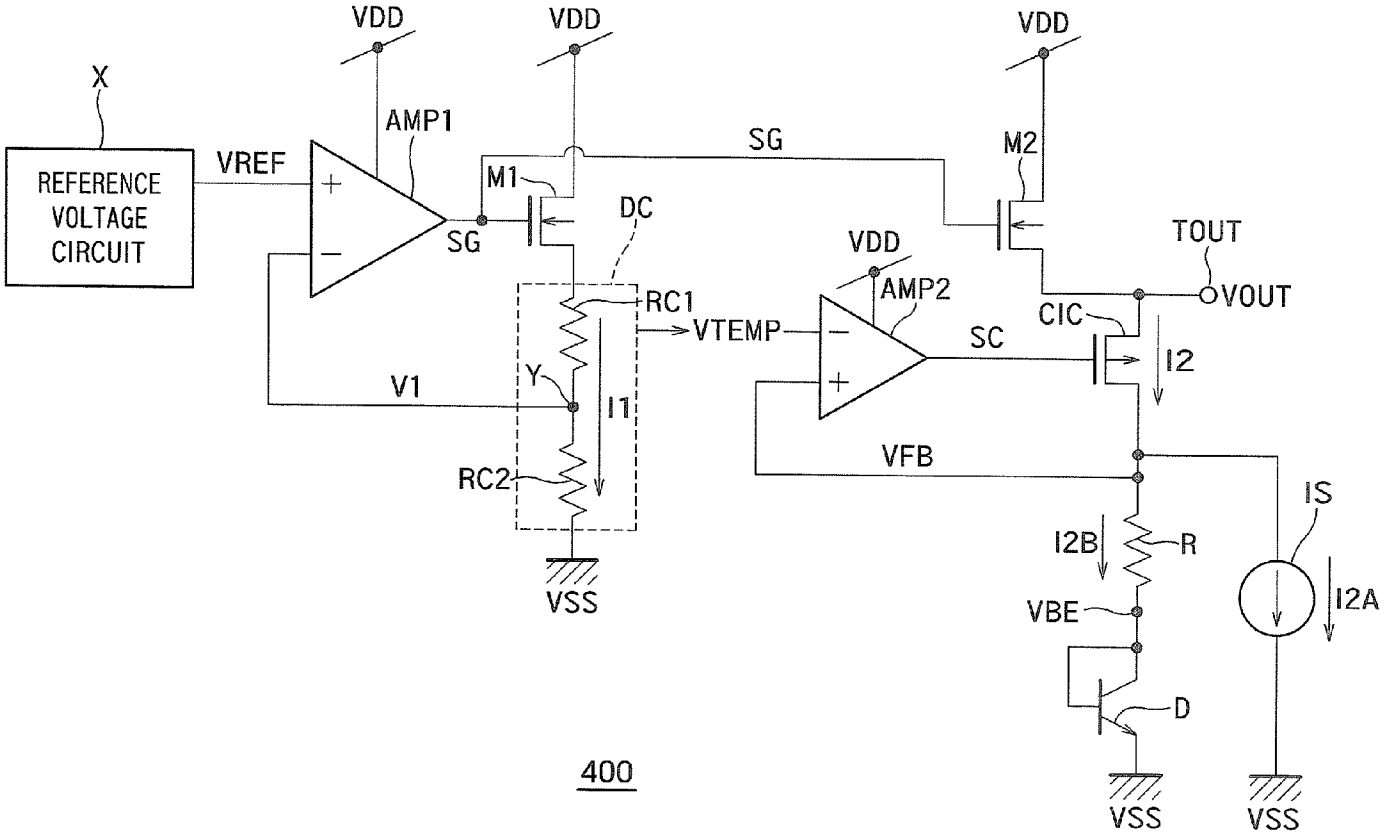
FIG. 6 is a circuit diagram showing an example of a configuration of a step-down regulator 400 according to the fourth embodiment.

FIG. 6 is a circuit diagram showing an example of a configuration of a step-down regulator 400 according to the fourth embodiment. In FIG. 6, the same reference numerals as those in FIG. 1 denote the same components as those in the first embodiment.

As shown in FIG. 6, as with the step-down regulator 100 according to the first embodiment, the step-down regulator 400 includes a first nMOS transistor "M1", a second nMOS transistor "M2", a voltage generating circuit "DC", a first error amplifying circuit "AMP1", an output terminal "TOUT", a current controlling circuit "CIC", a second error amplifying circuit "AMP2", a p-n junction diode "D", a linear load "IS", and a limiting resistor "R".

According to the fourth embodiment, the p-n junction diode "D" is a NPN bipolar transistor connected to the limiting resistor "R" at a collector and a base thereof and to a ground "VSS" at an emitter thereof.

The remainder of the configuration of the step-down regulator 400 is the same as that of the step-down regulator 100 shown in FIG. 1.

The operating characteristics of the step-down regulator 400 configured as described above are the same as the operating characteristics described in the first embodiment.

That is, as with the step-down regulator 100 according to the first embodiment, the step-down regulator 400 according to the fourth embodiment can reduce power consumption.

(Fifth Embodiment)

In a fifth embodiment, an example of a configuration of a step-down regulator including a limiting resistor provided by an on-resistance of a MOS transistor will be described.

Figure 7:
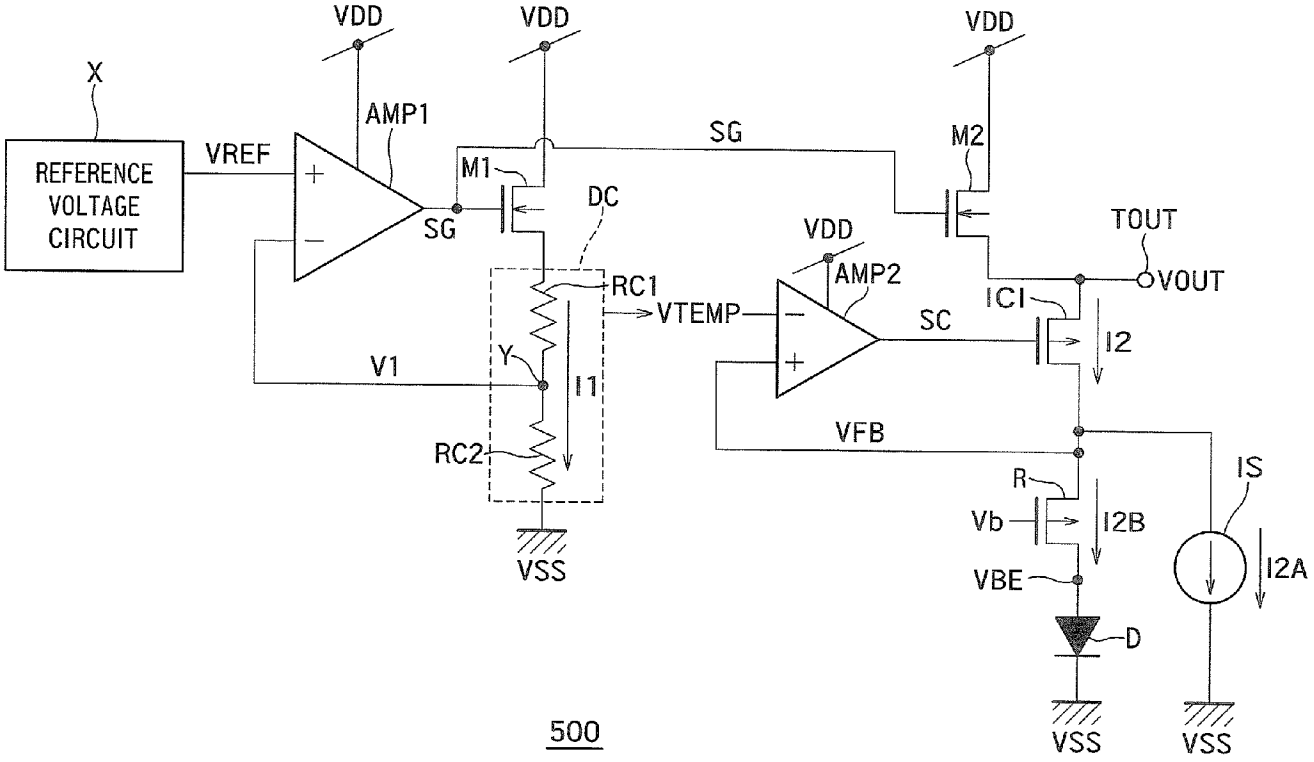
FIG. 7 is a circuit diagram showing an example of a configuration of a step-down regulator 500 according to the fifth embodiment.

FIG. 7 is a circuit diagram showing an example of a configuration of a step-down regulator 500 according to the fifth embodiment. In FIG. 7, the same reference numerals as those in FIG. 1 denote the same components as those in the first embodiment.

As shown in FIG. 7, as with the step-down regulator 100 according to the first embodiment, the step-down regulator 500 includes a first nMOS transistor "M1", a second nMOS transistor "M2", a voltage generating circuit "DC", a first error amplifying circuit "AMP1", an output terminal "TOUT", a current controlling circuit "CIC", a second error amplifying circuit "AMP2", a p-n junction diode "D", a linear load "IS", and a limiting resistor "R".

According to the fifth embodiment, the limiting resistor "R" is a pMOS transistor connected to the other end of the current controlling circuit "CIC" at a source thereof and to an anode of the p-n junction diode "D" and receives a fixed voltage at a gate thereof.

The second error amplifying circuit "AMP2" receives a second reference voltage "VTEMP" at an inverting input terminal thereof and receives a detected voltage "VFB" at a non-inverting input terminal thereof.

The current controlling circuit "CIC" is a pMOS transistor that is connected to an output terminal "TOUT" at a source thereof, to the inverting input terminal of the second error amplifying circuit "AMP2" at a drain thereof and to an output of the second error amplifying circuit "AMP2" at a gate thereof and receives a second control signal "SC" at the gate thereof.

The remainder of the configuration of the step-down regulator 500 is the same as that of the step-down regulator 100 shown in FIG. 1.

The operating characteristics of the step-down regulator 500 configured as described above is the same as the operation described in the first embodiment.

That is, as with the step-down regulator 100 according to the first embodiment, the step-down regulator 500 according to the fifth embodiment can reduce power consumption.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A step-down regulator, comprising:

a first transistor connected to a first potential at a first end thereof;

a voltage generating circuit that is connected between a second end of the first transistor and a second potential lower than the first potential and outputs a first voltage that is based on a voltage at the second end of the first transistor;

a first error amplifying circuit that receives a first reference voltage and the first voltage and supplies a first control signal to a control terminal of the first transistor so that the first reference voltage and the first voltage are equal to each other;

an output terminal at which an output voltage is output;

a second transistor that is connected to the first potential at a first end thereof, to the output terminal at a second end and to the control terminal of the first transistor at a control terminal thereof and receives the first control signal at the control terminal thereof;

a current controlling circuit that is connected to the output terminal at a first end thereof and is capable of controlling a current that flows between the first end thereof connected to the output terminal and a second end thereof;

a second error amplifying circuit that receives a voltage at the second end of the current controlling circuit and a second reference voltage and supplies a second control signal to the current controlling circuit so that the voltage at the second end of the current controlling circuit and the second reference voltage are equal to each other;

a diode that is connected to the second end of the current controlling circuit at an anode thereof and to the second potential at a cathode thereof; and a linear load that is connected in parallel with the diode between the second end of the current controlling circuit and the second potential.

2. The step-down regulator according to claim 1, wherein the diode is a p-n junction diode, the first transistor is a first nMOS transistor, and the second transistor is a second nMOS transistor.

3. The step-down regulator according to claim 2, wherein the first error amplifying circuit makes the first nMOS transistor and the second nMOS transistor operate in a weak inversion region by the first control signal.

4. The step-down regulator according to claim 1, further comprising a limiting resistor that is connected between the second end of the current controlling circuit and the anode of the diode.

5. The step-down regulator according to claim 2, further comprising a limiting resistor that is connected between the second end of the current controlling circuit and the anode of the diode.

6. The step-down regulator according to claim 3, further comprising a limiting resistor that is connected between the second end of the current controlling circuit and the anode of the diode.

7. The step-down regulator according to claim 1, wherein the voltage generating circuit is a voltage dividing circuit that generates and outputs a voltage obtained by dividing a voltage between the voltage at the second end of the first transistor and the second potential.

8. The step-down regulator according to claim 2, wherein the voltage generating circuit is a voltage dividing circuit that generates and outputs a voltage obtained by dividing a voltage between the voltage at the second end of the first transistor and the second potential.

9. The step-down regulator according to claim 3, wherein the voltage generating circuit is a voltage dividing circuit that generates and outputs a voltage obtained by dividing a voltage between the voltage at the second end of the first transistor and the second potential.

10. The step-down regulator according to claim 1, wherein the linear load is a constant current source that outputs a constant current.

11. The step-down regulator according to claim 2, wherein the linear load is a constant current source that outputs a constant current.

12. The step-down regulator according to claim 3, wherein the linear load is a constant current source that outputs a constant current.

13. The step-down regulator according to claim 1, wherein the second error amplifying circuit receives the second reference voltage at a non-inverting input terminal thereof and receives the voltage at the second end of the current controlling circuit at an inverting input terminal thereof, and the current controlling circuit is an nMOS transistor that is connected to the output terminal at a drain thereof, to the inverting input terminal of the second error amplifying circuit at a source thereof and to an output of the second error amplifying circuit at a gate thereof and receives the second control signal at the gate thereof.

14. The step-down regulator according to claim 2, wherein the second error amplifying circuit receives the second reference voltage at a non-inverting input terminal thereof and receives the voltage at the second end of the current controlling circuit at an inverting input terminal thereof, and the current controlling circuit is an nMOS transistor that is connected to the output terminal at a drain thereof, to the inverting input terminal of the second error amplifying circuit at a source thereof and to an output of the second error amplifying circuit at a gate thereof and receives the second control signal at the gate thereof.

15. The step-down regulator according to claim 3, wherein the second error amplifying circuit receives the second reference voltage at a non-inverting input terminal thereof and receives the voltage at the second end of the current controlling circuit at an inverting input terminal thereof, and the current controlling circuit is an nMOS transistor that is connected to the output terminal at a drain thereof, to the inverting input terminal of the second error amplifying circuit at a source thereof and to an output of the second error amplifying circuit at a gate thereof and receives the second control signal at the gate thereof.

16. The step-down regulator according to claim 1, wherein the second error amplifying circuit receives the second reference voltage at an inverting input terminal thereof and receives the voltage at the second end of the current controlling circuit at a non-inverting input terminal thereof, and the current controlling circuit is a pMOS transistor that is connected to the output terminal at a source thereof, to the inverting input terminal of the second error amplifying circuit at a drain thereof and to an output of the second error amplifying circuit at a gate thereof and receives the second control signal at the gate thereof.

17. The step-down regulator according to claim 2, wherein the second error amplifying circuit receives the second reference voltage at an inverting input terminal thereof and receives the voltage at the second end of the current controlling circuit at a non-inverting input terminal thereof, and the current controlling circuit is a pMOS transistor that is connected to the output terminal at a source thereof, to the inverting input terminal of the second error amplifying circuit at a drain thereof and to an output of the second error amplifying circuit at a gate thereof and receives the second control signal at the gate thereof.

18. The step-down regulator according to claim 3, wherein the second error amplifying circuit receives the second reference voltage at an inverting input terminal thereof and receives the voltage at the second end of the current controlling circuit at a non-inverting input terminal thereof, and the current controlling circuit is a pMOS transistor that is connected to the output terminal at a source thereof, to the inverting input terminal of the second error amplifying circuit at a drain thereof and to an output of the second error amplifying circuit at a gate thereof and receives the second control signal at the gate thereof.

19. The step-down regulator according to claim 4, wherein the limiting resistor is a MOS transistor that receives a fixed voltage at a gate thereof.

20. The step-down regulator according to claim 5, wherein the limiting resistor is a MOS transistor that receives a fixed voltage at a gate thereof.

* * * * *